US006559203B2

(12) United States Patent
Hutchings et al.

(10) Patent No.: US 6,559,203 B2
(45) Date of Patent: May 6, 2003

(54) FOUNDRY BINDER SYSTEMS CONTAINING AN ALKYL RESORCINOL AND THEIR USE

(75) Inventors: David A. Hutchings, Dublin, OH (US); Heimo J. Langer, Columbus, OH (US); Ken K. Chang, Dublin, OH (US); Thomas E. Dando, Sunbury, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/074,709

(22) Filed: Feb. 13, 2002

(65) Prior Publication Data

US 2003/0055125 A1 Mar. 20, 2003

Related U.S. Application Data

(60) Provisional application No. 60/269,660, filed on Feb. 16, 2001.

(51) Int. Cl.[7] ..... B22C 1/22; B22C 9/02; B22C 9/22

(52) U.S. Cl. ..... 523/142; 523/141; 523/143; 523/144; 523/145; 164/15; 164/16; 164/47

(58) Field of Search ..... 523/141, 142, 523/143, 144, 145; 164/15, 16, 47

(56) References Cited

U.S. PATENT DOCUMENTS

| | | | | |
|---|---|---|---|---|
| 3,903,192 A | | 9/1975 | Torck et al. | 260/683.68 |
| 4,172,042 A | * | 10/1979 | Kiisler et al. | |
| 4,221,873 A | | 9/1980 | Volodko et al. | 521/103 |
| 4,615,737 A | * | 10/1986 | Kiisler et al. | |
| 5,607,986 A | | 3/1997 | Kim et al. | 523/141 |
| 5,612,392 A | | 3/1997 | Chang et al. | 523/144 |
| 5,637,658 A | | 6/1997 | Teodorczyk | 525/480 |
| 5,646,219 A | | 7/1997 | Teodorczyk | 525/524 |
| 5,847,058 A | * | 12/1998 | Teodorczyk | |
| 5,856,375 A | | 1/1999 | Chang et al. | 523/145 |
| 6,037,389 A | * | 3/2000 | Archibald et al. | |

* cited by examiner

*Primary Examiner*—Tae H. Yoon
(74) *Attorney, Agent, or Firm*—David L. Hedden

(57) ABSTRACT

This invention relates to an organic foundry binder containing an alkyl resorcinol, or preferably a readily available mixture of alkyl resorcinols, and derivatives thereof. Preferably, the organic foundry binder is a furan binder. Foundry mixes are prepared by mixing the binder with a foundry aggregate. Foundry shapes (molds and cores) are prepared by shaping the mix and allowing it to cure to form a workable foundry shape. The invention also relates to the preparation of metal castings using the foundry shapes and the metal castings prepared with the foundry shapes.

16 Claims, No Drawings

FOUNDRY BINDER SYSTEMS CONTAINING AN ALKYL RESORCINOL AND THEIR USE

CROSS-REFERENCE TO RELATED APPLICATIONS

This application is a regular utility application based on U.S. provisional application serial No. 60/269,660 filed on Feb. 16, 2001, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to an organic foundry binder containing an alkyl resorcinol, or preferably a readily available mixture of alkyl resorcinols, and derivatives thereof. Preferably, the organic foundry binder is a furan binder. Foundry mixes are prepared by mixing the binder with a foundry aggregate. Foundry shapes (molds and cores) are prepared by shaping the mix and allowing it to cure to form a workable foundry shape. The invention also relates to the preparation of metal castings using the foundry shapes and the metal castings prepared with the foundry shapes.

(2) Description of the Related Art

In the foundry industry, one of the processes used for making metal parts is sand casting. In sand casting, disposable foundry shapes (usually characterized as molds and cores) are made by shaping and curing a foundry mix, which is a mixture of sand and an organic or inorganic binder. The binder is used to strengthen the molds and cores and can be heat cured, catalytically cured, or cured with a combination of heat and a catalyst.

One of the processes used in sand casting for making molds and cores is the cold-box process. In this process, a gaseous curing agent is passed through a compacted shaped mix to produce a cured mold and/or core. Some commonly used binders in this process are phenolic urethane binders, acrylic binders, epoxy-acrylic binders, furan binders, and alkaline phenolic resole binders.

One of the most commercially successful cold-box binders is the phenolic-urethane binder system, which is cured with a gaseous tertiary amine catalyst. See for example U.S. Pat. Nos. 3,409,579, 3,429,848, 3,432,457, and 3,676,392. The phenolic-urethane binder system consists of a phenolic resin component and polyisocyanate component, which are mixed with sand prior to compacting and curing to form a foundry mix. Such phenolic-urethane binders used in the cold-box process, have proven satisfactory for casting such metals as iron or steel which are normally cast at temperatures exceeding about 1400° C. They are also useful in the casting of light-weight metals, such as aluminum, which have melting points of less than 800° C.

There are disadvantages to using phenolic-urethane binders in the cold-box process. Both the phenolic resin component and polyisocyanate component generally contain a substantial amount of organic solvent which can be obnoxious to smell. Additionally, these binders contain small amounts of free formaldehyde and free phenol, which may be undesirable. Because of this, there is an interest in developing binders, which do not use organic solvents and do not contain free formaldehyde or free phenol.

Additionally, when the two components of the phenolic-urethane binder system are mixed with the sand to form a foundry mix, they may prematurely react before curing with the gaseous catalyst. If this reaction occurs, it will reduce the flowability of the foundry mix when it is used for making molds and cores, and the resulting molds and cores will have reduced strengths.

Another commonly used process in sand casting for making molds and cores is the no-bake process. The phenolic urethane binder system is one of the most commercially successful binders used in this process. However, in the no-bake process, a liquid curing catalyst (an amine in the case of phenolic urethane binders) is used and mixed with binder and foundry aggregate before shaping.

Because the molds and cores made by the no-bake process are usually quite large, weighing from 0.2 pounds to several tons, it is important to formulate a foundry mix which will provide sufficient worktime to allow time to shape the foundry mix in the pattern. Worktime is defined as the time interval after mixing the binder components and sand in a pattern, and the time when the foundry shape reaches a level of 60 on the Green Hardness "B" Scale Gauge sold by Harry W. Dietert Co., Detroit, Mich. On the other hand, the striptime for removing the foundry shape from the pattern must be diminished so that high productivity can be obtained. Striptime is the time interval after mixing the binder components and sand in a pattern, and the time when the foundry shape reaches a level of 90 on the Green Hardness "B" Scale Gauge. For commercial purposes, a desired worktime ranges from 2 minutes to 1.5 hours and a desired strip time of 4 minutes to 3 hours. The foundry shapes produced must have sufficiently high tensile strengths, so they can be handled after the striptime has elapsed. The cores and molds must also produce useful castings, i.e. castings that do not have defects such as veining, porosity, lustrous carbon, penetration, and erosion defects.

The foundry industry continues to be interested in no-bake binders that do not contain free formaldehyde and phenol; which have useful worktimes and striptimes for high production operations; and that produce foundry shapes with sufficiently high tensile strengths that can be used to make casting with minimal defects. Consequently, there is an interest in developing foundry binders with lower levels of VOC emissions, free phenol, and free formaldehyde that do not have unpleasant odors and generate little smoke during the core making and castings process.

Acid cured no-bake furan binders are attractive alternatives to the phenolic urethane no-bake binder system because they preferably do not contain free phenol, free formaldehyde, high levels of VOC emission, result in unpleasant odors, and generate lower smoke during the core-making and casting processes. However, one of the major problems with these binders system, is that they do not cure as rapidly as the phenolic urethane no-bake binders and the immediate tensile strengths of cores made with the binder systems create handling problems. Because of this, the furan binders are modified to increase their reactivity by incorporating other polymer or reactive monomers into the furan binder, e.g. urea formaldehyde resins, phenol formaldehyde resins, resole resins, resorcinol, bisphenol A tar, etc. Nevertheless, these modifications do not provide the cure speed and/or immediate tensile strengths that are needed in high productivity core shops.

In addition to increasing the cure rate of the binder, it is desirable to identify additives that impart greater mechanical strength to the cores and molds. These additives are also desirable for improved humidity and temperature resistance in the core and mold making process. Additionally, additives which lower free formaldehyde (scavenge), by reaction with it, are desirable.

Finally, it is desirable to identify materials that are lower cost than current product constituents are, but which are capable of performing in a manner that is comparable, or superior to the present constituent.

U.S. Pat. No. 5,847,058 discloses storage-stable phenol-aldehyde resole resins modified with an alkyl resorcinol modifier, preferably a readily available mixture of alkyl resorcinols. The modified resins are useful in the production of a wood composite (such as plywood, oriented strandboard, or fiberboard).

All citations referred to under this description of the "Related Art" and in the "Detailed Description of the Invention" are expressly incorporated by reference.

BRIEF SUMMARY OF THE INVENTION

This invention relates to a foundry binder system comprising:

A. an organic foundry binder; and

B. an Alkyl resorcinol ad mixtures thereof.

Foundry mixes are prepared by mixing the binder with a foundry aggregate. Foundry shapes (molds and cores) are prepared and allowed to cure to form a handleable or workable foundry shape. In the no-bake process, the catalyst is mixed with the aggregate and binder before shaping, while in the cold-box process the foundry mix is shaped and then exposed to a gaseous curing catalyst. The invention also relates to the preparation of metal castings using the foundry shapes and the metal castings prepared with the foundry shapes, particularly by the no-bake process. It is surprising that the improved properties result when the binders are used in the no-bake process, because no similar improvements result when the binders are used in the phenolic-urethane cold-box process.

The use of the alkyl resorcinol in the binder provides faster curing speeds for the binder and/or results in cores with improved immediate, intermediate, and/or long term tensile strengths. The addition of the alkyl resorcinol to the furan no-bake binder results in particular advantages. The advantages of the furan/alkyl resorcinol binder over the conventional no-bake furan binder system are as follows:

(1) The furan is highly soluble and compatible with the alkyl resorcinol, resulting in low viscosity binders where the components are highly compatible.

(2) Furfuryl alcohol typically used in furan binders can be reduced without adversely affecting the cure speed of the binder and the tensile properties of the cores prepared with the binder.

(4) Cores prepared with the furan binder containing an alkyl resorcinol cure rapidly and uniformly throughout, even when less furfuryl alcohol is used in the binder. The cure speeds of these binders match the cure speed of commercially successful phenolic urethane no-bake binders. Thus, they can be handled without breaking sooner, typically in 8 to 10 minutes, preferably less than 8 minutes. These benefits also make these binders suitable for high-speed core production foundries.

(5) The binders are advantageous from an environmental standpoint because they eliminate the need for phenolic or urea-formaldehyde additives. The result is that the binders do not contain free phenol or free formaldehyde, require little or no volatile organic solvents, and produce little odor and smoke during core-making and casting.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

The novel aspect of this invention relates to the use of an alkyl resorcinol in an organic foundry binder system, preferably a readily available mixture of alkyl resorcinols, all of which are disclosed in U.S. Pat. No. 5,847,058. For purposes of defining this invention, alkyl resorcinols also includes derivatives prepared by reacting an alkyl resorcinol with a phenolic resin, glutaraldehyde, formaldehyde, acetaldehyde, alkylaldehyde, arylaldehyde, furfural, furfuryl alcohol, bis-hydroxymethylfuran, benzaldehyde and its derivatives.

Representative examples of useful alkyl resorcinols include resorcinol substituted with the lower alkyls, e.g., ethyl, methyl, and/or propyl. Preferably, the alkyl resorcinol is a mixture of alkyl resorcinol compounds, which may contain various impurities. Most preferably, the mixture of alkyl resorcinols is obtained by thermal processing of the water-soluble Estonian oil shale phenols. The concentrate contains up to 55% 5-methyl resorcinol and other phenols and impurities. It is available under the name ALKYRES from the VIRU KEEMIA GRUPP Kohtla-Järve, Estonia.

The "Total Shale Phenols" is purified by known vacuum distillation techniques to separate four main fractions. One of these fractions, which distills at temperatures from 275° C. to 295° C., is referred to as "ALKYRES" by the supplier, and is a mixture of alkyl resorcinols as set forth in Table I:

TABLE I (Composition of the "ALKYRES" fraction distilled at 275° C. to 295° C.)

| Component | Weight Percent |
|---|---|
| Monohydric Phenols | 1 |
| Resorcinol | 1.5–2 |
| 2-Methylresorcinol | 1–1.5 |
| 4-Methylresorcinol | 2–4 |
| 5-Methylresorcinol | 45–55 |
| 2,5-Dimethylresorcinol | 14–16 |
| 4,5-Dimethylresorcinol | 6–7 |
| 5-Ethylresorcinol | 3–8 |
| 5-Propylresorcinol | 1 |
| Other resorcinol derivatives | 12–18 |

Another of these fractions, which distills at temperatures from 270° C. to 280° C., is referred to as "MALARES" by the supplier, and is a mixture of alkyl resorcinols as set forth in Table II:

TABLE II (Composition of the "MALARES" fraction distilled at 270° C. to 280° C.)

| Component | Weight Percent |
|---|---|
| Monohydric Phenols | 0.8–1 |
| Resorcinol | 13–15 |
| 2-Methylresorcinol | 0.6–0.8 |
| 5-Ethylresorcinol | 5–7 |
| 5-Methylresorcinol | Max. 25 |
| 2,5 dimethyl resorcinol | Min. 25 |
| 4,5 dimethyl resorcinol | 0.3–0.5 |
| Other resorcinol derivatives | 18–22 |

The amount of alkyl resorcinol used typically is from 0.5 to 50 parts based on 100 parts of the organic foundry binder, preferably 1 to 25 parts, most preferably 2 to 15 parts.

The organic binders are typically selected from the group consisting of phenolic urethane binders, furan binders, acid cured phenolic no-bake binder, alkaline phenolic resole binders, acrylic binders, epoxy-isocyanate-acrylic binder, and epoxy-acrylic binders among others, particularly in binder systems which normally employ resorcinol or resorcinol pitch. Although binders containing the alkyl resorcinol can be used in cold-box applications, the preferred binders are no-bake binders, most preferably furan no-bake binders.

With respect to the cold-box process, the curing takes place by blowing or ramming the foundry mix into a pattern and contacting the shaped foundry mix with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. The phenolic urethane binders are described in U.S. Pat. Nos., 3,485,497 and 3,409,579, which are hereby incorporated into this disclosure by reference. These binders are typically based on a two-part system, one part being a phenolic resin component and the other part being a polyisocyanate component. The epoxy-acrylic binders cured with sulfur dioxide in the presence of an oxidizing agent are described in U.S. Pat. No. 4,526,219, which is hereby incorporated into this disclosure by reference. Also included are epoxy-acrylic binders cured with amines as disclosed in U.S. Pat. No. 6,037,389, which is hereby incorporated by reference. Carbon dioxide (see U.S. Pat. No. 4,985,489, which is hereby incorporated into this disclosure by, reference) or methyl esters (see U.S. Pat. No. 4,750,716 which is hereby incorporated into this disclosure by reference) are used with alkaline phenolic resole resins.

Curing the foundry shape by the no-bake process takes place by mixing a liquid curing catalyst with the foundry mix, shaping the foundry mix containing the catalyst, and allowing the foundry shape to cure, typically at ambient temperature without the addition of heat. With respect to phenolic urethane no-bake binders, the preferred liquid curing catalyst is a tertiary amine and the preferred no-bake curing process is described in U.S. Pat. No. 3,485,797 which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

As was previously mentioned, the preferred binders are furan no-bake binders. The furan resins used in the no-bake binders are preferably low nitrogen furan resins. The furan resins are conventional furan resins prepared by the homopolymerization or copolymerization of furfuryl alcohol (hereafter a conventional furan resin) with other co-monomers such as phenol, urea, and phenol, or with urea-formaldehyde or phenol formaldehyde resins, or preferably furan resins prepared by the homopolymerization of bis-hydroxymethylfuran (hereafter a bis-hydroxymethylfuran resin), and mixtures of these resins. These resins are prepared by the homopolymerization or the copolymerization of the monomers in the presence of heat, according to methods well known in the art. The reaction temperature used in making the furan resins typically ranges from 95° C. to 105° C. The reaction is continued until the percentage of free formaldehyde is less than 5 weight percent, typically from 3 to 5 weight percent, preferably no free formaldehyde, and the refractive index is typically from 1.400 to about 1.500. The viscosity of the resin is preferably from about 200 cps to 450 cps. The furan resins have an average degree of polymerization of 2 to 3.

Although urea-formaldehyde and phenol-formaldehyde resins can be eliminated by using the furan binders described herein and are not preferred, modified furan resins can be used in the binder. Modified furan resins are typically made from furfuryl alcohol, urea formaldehyde, and formaldehyde at elevated temperatures under slightly alkaline conditions at a pH of from 7.0 to 8.0, preferably 7.0 to 7.2. The weight percent of furfuryl alcohol used in making the low nitrogen modified furan resins ranges from 60 to 75 percent; the weight percent of the urea formaldehyde used in making the low nitrogen modified furan resins ranges from 10 to 25 percent; and the weight percent of the formaldehyde used in making the low nitrogen modified furan resins ranges from 1 to 10 percent, where all weight percents are based upon the total weight of the components used to make the modified furan resin.

Although not necessarily preferred, urea-formaldehyde resins, phenol-formaldehyde resins, novolac resins, and phenolic resole resins may be used in addition to the furan resin.

The furan resin is preferably diluted with furfuryl alcohol to reduce the viscosity of the reactive furan resin.

A modifier may also be used in the binder. The modifier promotes the polymerization of furfuryl alcohol and is selected from the group consisting of resorcinol, resorcinol pitch, and bisphenol A tar. Preferably used as the activator is resorcinol. Resorcinol pitch is defined as the highly viscous product, which remains on the bottom of the reaction vessel after resorcinol is produced and distilled from the reaction vessel. Resorcinol pitch is a solid at room temperature and has a melting point of about 70° C. to 80° C. Resorcinol pitch is mostly dimers, trimers, and polymeric resorcinol. It may also contain substituted materials. Bisphenol A tar is defined as the highly viscous product, which remains on the bottom of the reaction vessel after bisphenol A is produced and distilled from the reaction vessel. The bisphenol A tar is a solid at room temperature and has a melting point of about 70° C. to 80° C. Bisphenol A tar is mostly dimers, trimers, and polymeric bis phenol A. It may also contain substituted materials.

The binder may also contain a bisphenol compound. The bisphenol compound used is bisphenol A, F, and S, but preferably is bisphenol A.

The binder may also contain a polyol. The polyol is selected from the group consisting of polyester polyols, polyether polyols, and mixtures thereof.

Aliphatic polyester polyols can be used in the binder. Aliphatic polyester polyols are well known and are prepared by reacting a dicarboxylic acid or anhydride with a glycol. They generally have an average hydroxyl functionality of at least 1.5. Preferably, the average molecular weight of the polyester polyol is from 300 to 800. The polyether polyols that are used are liquid polyether polyols or blends of liquid polyether polyols having a hydroxyl number of from about 200 to about 600, preferably about 300 to about 500 milligrams of KOH based upon one gram of polyether polyol. The viscosity of the polyether polyol is from 100 to 1,000 centipoise, preferably from 200 to 700 centipoise, most preferably 300 to 500 centipoise. The polyether polyols may have primary and/or secondary hydroxyl groups.

Although aliphatic polyester polyols and polyether polyols can be used in the binder, preferably the polyol used in the polyol component are liquid aromatic polyester polyols, or a blend of liquid aromatic polyester polyols, generally having a hydroxyl number from about 500 to 2,000, preferably from 700 to 1200, and most preferably from 250 to 600; a functionality equal to or greater than 2.0, preferably from 2 to 4; and a viscosity of 500 to 50,000 centipoise at 25° C., preferably 1,000 to 35,000, and most preferably 2,000 to 25,000 centipoise. They are typically prepared by the ester interchange of an aromatic ester and a polyol in the presence of an acidic catalyst. Examples of aromatic esters used to prepare the aromatic polyesters include phthalic anhydride and polyethylene terephthalate. Examples of polyols used to prepare the aromatic polyesters are ethylene glycol, diethylene glycol, triethylene glycol, 1,3, propane diol, 1,4 butane diol, dipropylene glycol, tripropylene glycol, tetraethylene glycol, glycerin, and mixtures thereof. Examples of commercial available aromatic polyester polyols are STEPANPOL polyols manufactured by Stepan Company, TERATE and Phenrez 178 polyol manufactured by Hoechst-Celanese, THANOL aromatic polyol manufactured by Eastman Chemical, and TEROL polyols manufactured by Oxide Inc.

It is preferred to include a silane in binder. Silanes that can be used can be represented by the following structural formula:

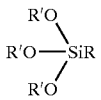

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. Examples of some commercially available silanes are Dow Corning Z6040; Union Carbide A-1100 (gamma aminopropyltriethoxy silane); Union Carbide A-1120 (N-beta(aminoethyl)-gamma-aminopropyltrimethoxy silane); and Union Carbide A-1160 (ureido-silane).

It will be apparent to those skilled in the art that other additives such as release agents, solvents, benchlife extenders, silicone compounds, etc. can be used and may be added to the binder composition, aggregate, or foundry mix.

Typically, the components of the furan no-bake binder systems are used in the following amounts: (a) from about 1 to about 50 parts by weight a reactive furan resin, preferably about 2 to 30 parts, most preferably from 6 to 22 parts (b) from about 10 to about 80 parts by weight furfuryl alcohol, preferably about 20 to 75, most preferably from 22 to 70, (c) from about 0.5 to about 50 parts by weight alkyl resorcinol, preferably from about 1 to 25, most preferably from 2 to 15 (d) from about 1 to about 30 parts by weight a bisphenol, preferably from about 2 to 15, most preferably from 3 to 12 (e) from about 0.1 to about 30 parts of a polyester polyol, preferably from about 2 to 20, most preferably from 3 to 15, (f) from about 0.01 to about 10 parts by weight a silane, preferably about 0.05 to about 5, most preferably from 0.07 to 3, where said parts are based upon 100 parts by weight of binder.

The aggregate used to prepare the foundry mixes is that typically used in the foundry industry for such purposes or any aggregate that will work for such purposes. Generally, the aggregate is sand, which contains at least 70 percent by weight silica. Other suitable aggregate materials include zircon, alumina-silicate sand, chromite sand, and the like. Generally, the particle size of the aggregate is such that at least 80 percent by weight of the aggregate has an average particle size between 40 and 150 mesh (Tyler Screen Mesh).

The amount of binder used is an amount that is effective in producing a foundry shape that can be handled or is self-supporting after curing. In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Although it is possible to mix the components of the binder with the aggregate in various sequences, it is preferred to add the curing catalyst to the aggregate and mix it with the aggregate before adding the binder.

Generally, curing is accomplished by filling a pattern (e.g. a mold or a core box) with the foundry mix to produce a workable foundry shape. A workable foundry shape is one that can be handled without breaking.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

ABBREVIATIONS

The following abbreviations are used in the Examples:

| | |
|---|---|
| AHS | aromatic hydrocarbon solvent. |
| ALKYRES | mixture of alkyl resorcinols as set forth in Table I. |
| BHMF | bis hydroxymethyl furan. |
| BOB | based on binder. |
| BOS | based on sand. |
| BPA TAR | distillate bottom during the manufacturing of bisphenol A. |
| CR-55-800 | a furan binder prepared by the blends of furfuryl alcohol with a co-reacted furfuryl alcohol and a urea formaldehyde resin and a co-reacted furfuryl alcohol with phenol formaldehyde resin sold under the trademark CHEM-REZ ® 55-800 by Ashland Specialty Chemicals Division of Ashland Inc. |
| CR-275 | a furan binder prepared by the blends of the furfuryl alcohol with a co-reacted furfuryl alcohol and a urea formaldehyde resin sold under the trademark CHEM-REZ ® 275 by Ashland Specialty Chemicals Division of Ashland Inc. |
| CR-400 | an alkaline phenolic no-bake binder sold by Ashland Specialty Chemicals Division of Ashland Inc. |
| DBE | dibasic ester solvent. |
| ECPCO | NOVASET ® 6020 binder, an alkaline phenolic no-bake liquid ester (triacetin) co-reactant sold by Ashland Specialty Chemicals Division of Ashland Inc. |
| FA | furfuryl alcohol. |

-continued

ABBREVIATIONS

The following abbreviations are used in the Examples:

| | |
|---|---|
| MALARES | mixture of alkyl resorcinols as set forth in Table II. |
| M-RES | 5-methyl resorcinol, and alkyl resorcinol. |
| PUNB | PEPSET ® 1670/2670 binder, an amine cured phenolic urethane no-bake binder system, having a Part I to Part II ratio of 55/45, and 3.0% amine catalyst based on the Part I, sold by Ashland Specialty Chemicals Division of Ashland Inc. |
| PEPO | a polyester polyol prepared by reacting dimethyl terephthalate (DMT) with diethylene glycol, such that the average molecular weight of the polyester polyol is about 600. |
| PF/FA | binder phenolic modified, furfuryl alcohol containing furan binder. |
| pbw | parts by weight based upon total parts. |
| PR RESIN | a phenolic resole benzylic ether resin such as that described in U.S. Pat. No. 3,485,797. |
| PN RESIN | phenolic novolac resin (phenolic novolac resin HRJ-1166, Batch W8-295 from Schenectady Chemicals). |
| RES | resorcinol. |
| RES PITCH | resorcinol pitch which comprises 5–10% resorcinol, 10–20% dihydroxydiphenyls (mostly 3',4-dihydroxydiphenyl), 30–50% trihydroxydiphenyls (mostly 2,4,3'-trihydroxydiphenyl), and 20–50% 1,3-benzenediol homopolymer. RM-441 is a solid and is typically used as an 80% emulsion material in water. |
| RH | relative humidity. |
| SILANE | Dynasylan 1506 sold by Degussa Hul |
| ST | strip time is the time interval between when the shaping of the mix in the pattern is completed and the time and when the shaped mixture can no longer be effectively removed from the pattern, and is determined by the Green Hardness tester. |
| TSA/BSA | 50:50 blend of toluene sulfonic acid/benzene sulfonic acid, a conventional furan curing catalyst in a solution that contains 32 weight percent water. |
| UF RESIN | urea formaldehyde concentrate sold by Georgia Pacific. |
| VINSOL | a dark color, high melting thermoplastic resin comprised of a complex mixture of various chemicals derived from southern pine wood. Its ingredients include acidic material derived from resin acids and oxidized resin acids, neutral high molecular weight compounds, and acidic phenolic materials in the form of substituted phenolic ethers, polyphenols, and other high molecular weight phenols. |
| WT | work time is the time interval between when mixing begins and when the mixture can no longer be effectively shaped to fill the mold or core and is determined by the Green Hardness tester. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated. All citations referred herein are expressly incorporated herein by reference.

Foundry binders were used to make foundry cores by the no-bake process using a liquid curing catalyst. Examples 1–2 are furan binders that use TSA/BSA as the curing catalyst. Examples 2–6 are furan binders that use TSA/BSA and zinc chloride as the curing catalyst. Example 7 is a phenolic urethane binder that uses a liquid tertiary amine catalyst. Example 8 illustrates the use of an alkaline phenolic resole resin, which is cured with a liquid ester as the curing catalyst. Unless otherwise indicated, the Control binders contained either resorcinol or resorcinol pitch as an additive instead of an alkyl resorcinol. The Controls are designated by letters instead of numbers.

Unless otherwise specified, foundry mixes were prepared by mixing Wedron 540 sand and the catalyst for 2 minutes with a Hobart mixer. Then one weight percent of the binder (bos) was added to the sand and mixed for 2 minutes. The foundry mixes tested had sufficient flowability and produced workable foundry shapes under the test conditions. The resulting foundry mixes were used to fill core boxes to make dogbone testing samples. Test shapes (dogbone shapes) were prepared to evaluate the sand tensile development and the effectiveness of the test shapes in making iron castings. Testing the tensile strength of the dogbone shapes enables one to predict how the mixture of sand and binder will work in actual foundry facilities. The dogbone shapes were stored at various times (e.g. 30 minutes, 1 hr, 3 hrs, and 24 hrs) in a constant temperature (CT) room at relative humidity (RH) of 50% and a temperature of 25° C. before measuring their tensile strengths. The results are the average of three tests.

Example A and 1

Example A and 1 illustrates the effect of adding ALKYRES to a traditional furan binder, CR 55-800, cured with 25 weight percent TSA/BSA BOS. Control A contains no additive.

| Test Conditions | |
|---|---|
| Sand: | Wedron 540 |
| CT Room: | 45% RH, 25° C. |
| Sand Lab: | 26% RH, 22° C. |
| Catalyst: | 25% BOB |
| Binder: | 1.2% BOS |

| Binder Formulation | A | 1 |
|---|---|---|
| CR-55-800 | 100 | 85 |
| ALKYRES/FA (1:1) | 0 | 15 |
| SILANE | 0.19 | 0.19 |
| Total | 100.00 | 100.00 |

TABLE II

Tensile data after extended development

| | | Tensile Strengths (psi) | | |
|---|---|---|---|---|
| Example | WT/ST (min) | 30 min | 1 hrs | 24 hrs @ RH (50%) |
| A | 17'18"/26'06" | 51 | 149 | 337 |
| 1 | 12'31"/17'05" | 81 | 202 | 376 |

Table II shows that the addition of ALKYRES improves the cure speed and tensile strength of cores prepared with the furan binder cured with TSA/BSA as the catalyst. The cure speed enhancement provides quick core stripping and improves the productivity for the no-bake foundry.

Example B and 2

The binder used in Example B and 2 was a furan binder as described below and the curing catalyst was TSA/BSA. In Comparison Example B, resorcinol was used as an additive instead of the alkyl resorcinol.

| Test Conditions: | |
|---|---|
| Sand: | Wedron 540 |
| CT Room: | 50% RH, 25° C. |
| Sand Lab: | 23% RH, 23° C. |
| Catalyst: | 25% BOB |
| Binder: | 1.2% BOS |

| | Binder Formulation | |
|---|---|---|
| | B | 2 |
| FA | 66.08 | 66.08 |
| BIS A | 9.90 | 9.90 |
| CR-275 | 15.00 | 15.00 |
| PEPO | 5.50 | 5.50 |
| ALKYRES | — | 3.39 |
| SILANE | 0.13 | 0.13 |
| RES | 3.39 | — |
| | 100.00 | 100.00 |

TABLE III

| Tensile Data (30 minutes after shaping) | | |
|---|---|---|
| Example | WT/ST (min) | Tensile Strengths after 30 minutes (psi) |
| B | 6'/8' | 93 |
| 2 | 6'/9' | 140 |

Table III shows that using ALKYRES instead of resorcinol improves the early tensile strength of cores prepared with the furan binder cured with TSA/BSA. The high early tensile strength provides easier core/mold stripping and handling.

Example C and 3

Examples C and 3 are similar to Example B and 2, except resorcinol pitch is used as the additive for comparison purposes instead of resorcinol.

| Test Conditions: | |
|---|---|
| Sand: | Wedron 540 |
| CT Room: | 50% RH, 25° C. |
| Sand Lab: | 12% RH, 25° C. |
| Catalyst: | 25% BOB |
| Binder: | 1.2% BOS |

| | Binder Formulation | |
|---|---|---|
| | C | 3 |
| FA | 60.49 | 62.69 |
| BIS A | 9.90 | 9.90 |
| CR-275 | 15.00 | 15.0 |
| PEPO | 5.50 | 5.50 |
| ALKYRES | — | 6.78 |

-continued

| | Binder Formulation | |
|---|---|---|
| | C | 3 |
| RES PITCH | 8.48 | — |
| SILANE | 0.13 | 0.13 |
| Total | 100.00 | 100.0 |

TABLE IV

| Tensile data after extended development | | | | | |
|---|---|---|---|---|---|
| | | Tensile Strengths (psi) | | | |
| Example | WT/ST (min) | 1 hr | 3 hrs | 24 hrs | 24 hrs @ RH (90%) |
| C | 3'30"/6'00" | 129 | 153 | 165 | 114 |
| 3 | 4'15"/7'15" | 156 | 170 | 209 | 143 |

Table IV shows that using ALKYRES instead of resorcinol pitch improves the later tensile strength of cores prepared with the furan binder cured with TSA/BSA.

Example D and 4

Example D and 4 are similar to Example B and 2 except the binder also contained BHMF and PEPO, and the catalyst used was an 80:20 mixture of

| Test Conditions: | |
|---|---|
| Sand: | Wedron 540 |
| CT Room: | 42% RH, 25° C. |
| Sand Lab: | 21% RH, 21° C. |
| Catalyst: | 25% BOB |
| Binder: | 1.2% BOS |

| | Binder Formulation | |
|---|---|---|
| | D | 4 |
| FA | 52.86 | 52.86 |
| BIS A | 7.92 | 7.92 |
| CR-275 | 12.0 | 12.0 |
| PEPO | 4.4 | 4.4 |
| BHMF | 20.0 | 20.0 |
| ALKYRES | — | 2.71 |
| RES | 2.71 | — |
| SILANE | 0.11 | 0.11 |
| Total | 100.00 | 100.00 |

TABLE V

| Tensile data after extended development | | | | |
|---|---|---|---|---|
| | | Tensile Strengths (psi) | | |
| Example | WT/ST (min) | 1 hrs | 3 hrs | 24 hrs @ RH (50%) |
| D | 7'41"/11'20 | 130 | 275 | 285 |
| 4 | 5'20"/7'41" | 172 | 280 | 296 |

Table V shows that using ALKYRES instead of resorcinol pitch improves the later tensile strength of cores prepared with the furan binder containing BHMF and the catalyst containing TSA/BSA and zinc chloride.

Example E, F, G, and 4

Example E, F, G, and 4 also use the catalyst of Example 3. These examples compare the effect of using a polyester polyol instead of other known reinforcing agents.

| Test Conditions | |
|---|---|
| Sand: | Wedron 540 |
| CT Room: | 42% RH, 25° C. |
| Sand Lab: | 21% RH, 21° C. |
| Catalyst: | 25% BOB |
| Binder: | 1.2% BOS |

| | Binder Formulation | | | |
|---|---|---|---|---|
| | E | F | G | 5 |
| FA | 41.18 | 41.18 | 41.18 | 41.18 |
| PF/FA | 39.24 | 39.24 | 39.24 | 39.24 |
| ALKYRES | 7.30 | 7.30 | 7.30 | 7.30 |
| U/F resin | 2.40 | 2.40 | 2.40 | 2.40 |
| PN resin | 9.70 | | | |
| BPA tar | | 9.70 | | |
| VINSOL | | | 9.70 | |
| PEPO | | | | 9.70 |
| SILANE | 0.19 | 0.19 | 0.19 | 0.19 |
| Total | 100.0 | 100.0 | 100.0 | 100.0 |

TABLE VI

Tensile data after extended development

| | | Tensile Strengths (psi) | | |
|---|---|---|---|---|
| Example | WT/ST (min) | 30 min | 1 hrs | 24 hrs @ RH (50%) |
| E | 6'33"/11'00" | 83 | 169 | 220 |
| F | 4'07"/7'00" | 137 | 187 | 227 |
| G | 8'30"/11'00" | 88 | 149 | 350 |
| 5 | 9'47"/11'58" | 158 | 339 | 431 |

Table VI shows that the addition of a polyester polyol to the binder formulation containing ALKYRES, instead of other traditional reinforcing agents, such as bisphenol A tar, a novolac resin, or VINSOL, improves the later tensile strengths of cores prepared with the furan binder cured with the TSA/BSA catalyst.

Example H and 6

Example H and 5 compare 5-methyl resorcinol to resorcinol, as an additive for the furan binder using TSA/BSA as the curing catalyst. In these tests, the through-cure or deepset performance were measured. The through cure test was done by filling a cup with sand mix which was subsequently rammed. Four and six minutes after the sand mix reaches the strip time (Green Hardness of 90), the sand mix was removed from the cup and the uncured sand was brushed off. The cured core was weighed and compared to the weight of the original sand mix. The through cure is expressed as the weight of cured core divided by the weight of the original sand mix. Through-cure (%)=(weight of cured core/weight of the original sand mix)×100.

| Test Conditions | |
|---|---|
| Sand: | Wedron 540 |
| CT Room: | 50% RH, 25° C. |
| Sand Lab: | 9% RH, 27° C. |
| Catalyst: | 25% BOB |
| Binder: | 1.2% BOS |

| | Binder Formulation | |
|---|---|---|
| | R | 6 |
| Furfuryl Alcohol | 66.08 | 66.08 |
| BIS A | 9.90 | 9.90 |
| CR-275 | 15.0 | 15.0 |
| PHEN-REZ 178 | 5.50 | 5.50 |
| 5-MRES | 0 | 3.39 |
| RES | 3.39 | 0 |
| SILANE | 0.13 | 0.13 |
| Total | 100.00 | 100.00 |

TABLE VII

Curing profile of binders

| | | Percentage cure after stripping and specified times after stripping | | | | |
|---|---|---|---|---|---|---|
| Example | WT/ST | At strip | 1 min | 2 min | 4 min | 6 min |
| H | 6'00"/8'15" | 0 | 0 | 0 | 36.1 | 98.6 |
| 6 | 6'00"/9'00" | 0 | 0 | 0 | 98.0 | 98.2 |

This example shows the advantage of using 5-methyl resorcinol to improve the core through-cure of the furan binder. The higher through-cure performance enables the foundry to strip the core faster and reduce core cracking during core handling.

Example I, J, K and 7

Example I and 7 use a no-bake phenolic urethane binder cured with a liquid amine catalyst, PEP SET® 3701 catalyst. The polyisocyanate component used was PEP SET® 2670 binder. Control J contained no additive. In Example 7, five weight percent of the base resin used in the binder was replaced with ALKYRES. In Example K, five weight percent of the base resin used in the binder was replaced with resorcinol. In Example L, five weight percent of the base resin used in the binder was replaced with bisphenol A tar.

| Test Conditions | |
|---|---|
| Sand: | Wedron 540 |
| Sand Lab: | 36% RH, 23° C. |
| CT Room: | 50% RH, 25° C. |
| Binder: | 1.00% BOS |
| Mix ratio | Part I/Part II (55/45) |
| Catalyst | 3.00% BOS |

| Base Resin Formulation | I | J | K | 7 |
|---|---|---|---|---|
| PR RESIN | 57.0 | 52.0 | 52.0 | 52.0 |
| AHS | 28.7 | 28.7 | 28.7 | 28.7 |
| DBE | 14.3 | 14.3 | 14.3 | 14.3 |
| RES | 0 | 5.0 | 0 | 0 |
| BPTAR | 0 | 0 | 5.0 | 0 |
| ALKYRES | 0 | 0 | 0 | 5 |
| SILANE | 0.19 | 0.19 | 0.19 | 0.19 |
| Total | 100.0 | 100.0 | 100.00 | 100.00 |

TABLE IX

Tensile data after extended development

| Example | WT/ST (min) | Tensile Strengths (psi) 1 hr | 3 hrs |
|---|---|---|---|
| 1 | 3'30"/5'00 | 113 | 191 |
| J | 3'45"/5'45" | 83 | 132 |
| K | 4'15"/5'45" | 87 | 161 |
| 7 | 4'45"/6/30" | 160 | 211 |

These examples show that the intermediate tensile strengths of cores made with the amine cured phenolic urethane no-bake binder containing the ALKYRES are improved.

Example L and 8

These examples illustrate the effect of using ALKYRES in the co-reactant of an ester cured alkaline phenolic resole resin (CR-400), which is slower curing no-bake binder, instead resorcinol.

| Test Conditions | |
|---|---|
| Sand: | Wedron 540 |
| Sand Lab: | 11% RH, 27° C. |
| Binder: | 1.25% BOS |
| Co-reactant | 25% BOB |

| Co-reactant Formulation | L | 8 |
|---|---|---|
| TRIACETIN | 64 | 64 |
| DBE | 31 | 31 |
| RES | 5 | 0 |
| ALKYRES | 0 | 5 |
| Total | 100.00 | 100.00 |

TABLE IX

Tensile data after extended development

| Example | WT/ST (min) | Tensile Strengths (psi) 5 hrs | 24 hrs | 24 hrs @ RH (50%) |
|---|---|---|---|---|
| L | 16'42"/28'15" | 91 | 109 | 65 |
| 8 | 15'15"/23'00" | 131 | 141 | 103 |

These examples show a general improvement in the long-term tensile strengths and humidity resistance of cores made with the alkaline phenolic resole no-bake binder containing the ALKYRES.

Example M, 9, and 10

Use of MALARES as Additive

Examples M, 9, and 10 are similar to Examples H and 5, except resorcinol was compared to ALKYRES and MALARES, as an additive for the furan binder using TSA/BSA as the curing catalyst.

| Test Conditions | |
|---|---|
| Sand: | Wedron 540 |
| CT Room: | 50% RH, 25° C. |
| Sand Lab: | 33 RH, 24° C. |
| Catalyst: | 30% BOB |
| Binder: | 1.0% BOS |

| Binder Formulation | M | 9 | 10 |
|---|---|---|---|
| Furfuryl Alcohol | 66.08 | 66.08 | 66.08 |
| BIS A | 9.90 | 9.90 | 9.90 |
| CR-275 | 15.0 | 15.0 | 15.0 |
| PHEN-REZ 178 | 5.50 | 5.50 | 5.50 |
| RES | 3.39 | 0 | 0 |
| ALKYRES | 0 | 3.39 | 0 |
| MALARES | 0 | 0 | 3.39 |
| SILANE | 0.13 | 0.13 | |
| Total | 100.00 | 100.00 | 100.00 |

TABLE VII

Curing profile of binders

| Example | Work Time | Strip Time | 1 hour | 3 hours | 24 hours | 24 hours @ 90% RH |
|---|---|---|---|---|---|---|
| M | 6'30" | 8'30" | 189 | 269 | 287 | 177 |
| 9 | 7'00" | 10'45" | 214 | 203 | 232 | 160 |
| 10 | 7'00" | 10'00" | 213 | 310 | 300 | 199 |

The data indicate, as before, that the early tensile strength of the test cores improve when the ALKYRES is substituted for the resorcinol, but the later tensile strengths are not as good as when the resorcinol is used. However, both the early and later tensile strengths are improved when MALARES is substituted for the resorcinol. It is surprising that the later tensile strengths improve, because MALARES contains only 13–15 weight percent resorcinol.

What is claimed is:

1. A foundry binder system comprising:

(a) an organic foundry binder selected from the group consisting of amine curable phenolic urethane binders, furan binders, acrylic binders, epoxy-isocyanate-acrylic binder, and epoxy-acrylic binders; and (b) a mixture of alkyl resorcinols and the mixture contains 5-methylresorcinol.

2. The foundry binder system of claim 1 wherein the foundry binder is a furan binder.

3. The foundry binder system of claim 2 wherein (b) is a mixture of alkyl resorcinols comprising:

| Component | Amount |
|---|---|
| Monohydric phenols | 1 |
| Resorcinol | 1.5–2 |
| 2-methylresorcinol | 1–1.5 |
| 4-methylresorcinol | 2–4 |
| 5-methylresorcinol | 45–55 |
| 2,5-dimethylresorcinol | 14–16 |
| 4,5-dimethylresorcinol | 6–7 |
| 5-ethylresorcinol | 3–8 |
| 5-propylresorcinol | 1 |
| Other resorcinol derivatives | 12–18. |

4. The foundry binder system of claim 2 wherein (b) is a mixture of alkyl resorcinols comprising:

| Component | Weight Percent |
|---|---|
| Monohydric Phenols | 0.8–1 |
| Resorcinol | 13–15 |
| 2-Methylresorcinol | 0.6–0.8 |
| 5-Ethylresorcinol | 5–7 |
| 5-Methylresorcinol | Max. 25 |
| 5-Ethylresorcinol | Max. 25. |

5. The foundry binder system of claim 3 wherein the amount of alkyl resorcinol is from 1 to 25 weight percent based upon the weight of the foundry binder (a).

6. The foundry binder system of claim 4 wherein the amount of alkyl resorcinol is from 1 to 25 weight percent based upon the weight of the foundry binder (a).

7. The foundry binder system of claim 5 wherein the furan resin contains furfuryl alcohol.

8. The foundry binder system of claim 6 wherein the furan resin contains furfuryl alcohol.

9. The foundry binder system of claim 7 wherein the furan resin component further comprises a polyol selected from the group consisting of polyester polyols, polyether polyols, and mixtures thereof.

10. The foundry binder system of claim 8 wherein the furan resin component further comprises a polyol selected from the group consisting of polyester polyols, polyether polyols, and mixtures thereof.

11. The foundry binder system of claim 9 wherein the furan resin contains an additive selected from the group consisting of resorcinol, resorcinol pitch, bisphenol A, bisphenol A tar, and mixtures thereof.

12. The foundry binder system of claim 10 wherein the furan resin contains an additive selected from the group consisting of resorcinol, resorcinol pitch, bisphenol A, bisphenol A tar, and mixtures thereof.

13. A foundry mix comprising:

A. a major amount of foundry aggregate, and

C. a foundry binder system comprising:

(1) an organic foundry binder selected from the group consisting of amine curable phenolic urethane binders, furan binders, acid cured phenolic no-bake binder, alkaline phenolic resole binders, acrylic binders, epoxy-isocyanate-acrylic binder, and epoxy-acrylic binders; and (2) a mixture of alkyl resorcinols and the mixture contains 5-methylresorcinol, wherein the weight ratio of A to B is from 100:1 to 100:10.

14. A process for preparing a foundry shape comprising:

A. shaping the foundry mix of claim 13 into a foundry shape; and

B. allowing the foundry shape to cure into a workable foundry shape.

15. A foundry shape prepared in accordance with claim 14.

16. A method for preparing a metal casting comprising:

(a) fabricating a shape in accordance with claim 14;

(b) pouring, molten metal into and around said shape;

(c) allowing said metal to cool and solidify; and (d) then separating the molded article.

* * * * *